US009752298B2

(12) United States Patent
Nakamura et al.

(10) Patent No.: US 9,752,298 B2
(45) Date of Patent: Sep. 5, 2017

(54) TRACE GENERATION DEVICE AND WORKING MACHINE

(71) Applicant: Hitachi, Ltd., Chiyoda-ku, Tokyo (JP)

(72) Inventors: Satoshi Nakamura, Tokyo (JP); Saku Egawa, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 14/990,327

(22) Filed: Jan. 7, 2016

(65) Prior Publication Data

US 2016/0258128 A1 Sep. 8, 2016

(30) Foreign Application Priority Data

Mar. 5, 2015 (JP) ..... 2015-043086

(51) Int. Cl.
*E02F 3/43* (2006.01)
*E02F 9/26* (2006.01)
*E02F 9/20* (2006.01)

(52) U.S. Cl.
CPC ..... *E02F 3/43* (2013.01); *E02F 3/437* (2013.01); *E02F 9/2029* (2013.01); *E02F 9/26* (2013.01); *E02F 9/265* (2013.01)

(58) Field of Classification Search
None
See application file for complete search history.

(56) References Cited

U.S. PATENT DOCUMENTS 4,829,418 A * 5/1989 Nielsen ..... E02F 3/435 172/4.5
5,065,326 A * 11/1991 Sahm ..... E02F 3/438 340/686.1
5,257,177 A * 10/1993 Bach ..... B66C 13/066 340/685
5,446,981 A * 9/1995 Kamada ..... E02F 3/437 172/2
5,701,691 A * 12/1997 Watanabe ..... E02F 9/2033 172/4
5,826,666 A * 10/1998 Tozawa ..... E02F 3/437 172/2
5,974,352 A * 10/1999 Shull ..... E02F 3/432 172/4.5
6,208,925 B1 * 3/2001 Creger ..... E02F 3/432 172/3

(Continued)

FOREIGN PATENT DOCUMENTS

JP 2011-252338 A 12/2011

*Primary Examiner* — Jonathan M Dager
(74) *Attorney, Agent, or Firm* — Crowell & Moring LLP

(57) ABSTRACT

In a trace generation device including a trace generation determination unit that outputs a command of trace generation, when a difference of an actual load applied to a bucket and a reference load is equal to or larger than a predetermined value during excavation and a candidate trace generation unit that generates a trace in which a work amount is almost constant, after the command is output, the reference load is an estimated load and the command of the trace generation is output when the difference of the actual load and the estimated load is equal to or larger than the predetermined value during the excavation. As a result, working efficiency can be raised while a trace in which an excavation amount is almost constant is generated.

5 Claims, 12 Drawing Sheets

(56) References Cited

U.S. PATENT DOCUMENTS 6,211,471 B1 * 4/2001 Rocke ..... G01G 19/083 177/136
6,225,574 B1 * 5/2001 Chang ..... G01G 19/08 177/139
6,275,757 B1 * 8/2001 Watanabe ..... E02F 3/437 172/6
6,317,669 B1 * 11/2001 Kurenuma ..... E02F 3/434 172/2
6,655,465 B2 * 12/2003 Carlson ..... E02F 3/847 172/4.5
6,691,437 B1 * 2/2004 Yost ..... E02F 3/435 356/141.2
6,711,838 B2 * 3/2004 Staub ..... E02F 9/26 172/2
6,934,616 B2 * 8/2005 Colburn ..... E02F 9/264 37/414
7,010,367 B2 * 3/2006 Koch ..... E02F 9/2004 700/83
7,640,683 B2 * 1/2010 McCain ..... E02F 3/437 37/348
7,669,354 B2 * 3/2010 Aebischer ..... E02F 9/26 37/348
7,748,147 B2 * 7/2010 Schoenmaker ..... E02F 3/434 37/348
7,752,778 B2 * 7/2010 Schoenmaker ..... E02F 3/439 37/348
7,894,962 B2 * 2/2011 Sahlin ..... E02F 3/847 37/348
7,979,181 B2 * 7/2011 Clark ..... E02F 3/434 414/685
8,135,518 B2 * 3/2012 Budde ..... E02F 9/265 701/50
8,145,394 B2 * 3/2012 Chiorean ..... E02F 3/435 701/33.1
8,190,336 B2 * 5/2012 Verkuilen ..... E02F 9/265 37/348
8,205,164 B2 * 6/2012 Kim ..... E02F 9/26 340/691.6
8,244,438 B2 * 8/2012 Koch ..... E02F 3/432 212/284
8,355,847 B2 * 1/2013 Colwell ..... E02F 3/46 307/9.1
8,463,508 B2 * 6/2013 Nicholson ..... E02F 3/432 172/3
8,527,158 B2 * 9/2013 Faivre ..... E02F 9/2033 37/411
8,577,564 B2 * 11/2013 Stanek ..... E02F 3/435 701/50
8,620,535 B2 * 12/2013 Friend ..... G05D 1/0278 172/1
8,644,964 B2 * 2/2014 Hendron ..... G05B 11/01 700/20
8,738,242 B2 * 5/2014 Konno ..... E02F 3/845 172/25
8,903,604 B2 * 12/2014 Fukano ..... E02F 9/264 432/1
8,930,091 B2 * 1/2015 Upcroft ..... E02F 3/48 37/348
9,043,098 B2 * 5/2015 Nomura ..... E02F 3/32 340/995.27
9,109,345 B2 * 8/2015 Okamura ..... E02F 3/436
9,304,501 B2 * 4/2016 Danko ..... B25J 9/1628
9,388,550 B2 * 7/2016 Wei ..... E02F 9/2029
9,394,671 B2 * 7/2016 Hirozawa ..... E02F 9/2217
9,435,105 B2 * 9/2016 Fleischmann ..... A01G 23/00
9,464,410 B2 * 10/2016 Johnson ..... E02F 9/2079
9,562,341 B2 * 2/2017 Voelz ..... E02F 3/435
2002/0077737 A1 * 6/2002 Kalafut ..... E02F 9/26 701/50
2002/0087245 A1 * 7/2002 Rossow ..... E02F 9/26 701/50
2003/0001750 A1 * 1/2003 Ishimoto ..... B66C 13/18 340/691.6
2003/0001751 A1 * 1/2003 Ogura ..... E02F 9/26 340/691.6
2004/0158355 A1 * 8/2004 Holmqvist ..... G05D 1/0236 700/245
2004/0210370 A1 * 10/2004 Gudat ..... E02F 3/435 701/50
2004/0267404 A1 * 12/2004 Danko ..... B25J 9/1607 700/245
2005/0004734 A1 * 1/2005 Cripps ..... E02F 9/2029 701/50
2005/0027420 A1 * 2/2005 Fujishima ..... E02F 9/2045 701/50
2006/0245896 A1 * 11/2006 Alshaer ..... E02F 9/2029 414/685
2007/0010925 A1 * 1/2007 Yokoyama ..... E02F 9/261 701/50
2007/0168100 A1 * 7/2007 Danko ..... B25J 9/1628 701/50
2007/0255454 A1 * 11/2007 Dariush ..... G06N 3/008 700/245
2009/0009308 A1 * 1/2009 Date ..... B60R 1/00 340/439
2009/0204259 A1 * 8/2009 Danko ..... G05B 13/024 700/250
2011/0153167 A1 * 6/2011 Kahle ..... E02F 3/32 701/50
2012/0246981 A1 * 10/2012 Magaki ..... E02F 9/2075 37/443
2013/0006484 A1 * 1/2013 Avitzur ..... E02F 9/205 701/50
2014/0088838 A1 * 3/2014 Furem ..... B65G 67/04 701/50
2015/0240453 A1 * 8/2015 Jaliwala ..... E02F 9/2041 701/50
2016/0003171 A1 * 1/2016 Ge ..... E02F 9/2246 701/102
2016/0369475 A1 * 12/2016 Tanaka ..... E02F 3/40

* cited by examiner

TRACE GENERATION DEVICE AND WORKING MACHINE

BACKGROUND OF THE INVENTION

1. Field of the Invention

The present invention relates to a trace generation device and a working machine.

2. Description of the Related Art

Generally, a working machine provided with a bucket represented by a hydraulic shovel performs excavation/loading work for driving join mechanisms connected sequentially from a vehicle body, inserting the bucket into an excavation target, excavating earth and sand, loading the excavated earth and sand on a transporting machine, repeating these works alternately, and fully filling the transporting machine with the earth and the sand.

Efficiency of the excavation/loading work is represented by a work time needed until the transporting machine is filled fully with the earth and the sand without excess and deficiency. At this time, when an insertion amount of the bucket is large, a load applied from the excavation target to the bucket becomes excessive and exceeds maximum generation force of the working machine and an excavation operation is stopped in the middle of the excavation or the operation is delayed, a working time increases, and working efficiency is deteriorated. In addition, when an excavation target is firm and heavy, the load exceeds the maximum generation force of the working machine and the excavation operation is stopped or the operation is delayed and the working efficiency is deteriorated, similar to the above case.

Meanwhile, technology for reducing the load by modifying the operation during the excavation work is developed. A construction machine that operates a load during working from an angle of the bucket of the working machine, determines an operation modification when the load exceeds the upper limit, and executes control to lift a boom of the working machine is disclosed in JP-2011-252338-A.

SUMMARY OF THE INVENTION

The construction machine disclosed in JP-2011-252338-A executes an operation to lift the boom to reduce the load. For this reason, an excavation amount decreases when the boom is lifted before a sufficient excavation amount is obtained and the working efficiency is deteriorated.

An object of the present invention is to raise working efficiency while generating a trace in which an excavation amount is almost constant.

An aspect of the present invention for resolving the above problem is as follows.

A trace generation (path generation) device includes: a trace generation determination unit 62 that outputs a command of trace generation, when a difference of an actual load applied to a bucket 15 and a reference load is equal to or larger than a predetermined value during excavation; and a candidate trace generation unit 70 that generates a trace in which a work amount is almost constant, after the command is output.

The present invention can raise working efficiency while generating a trace in which an excavation amount is almost constant. Other objects and advantages of the invention will become apparent from the following description of embodiments with reference to the accompanying drawings.

DESCRIPTION OF THE PREFERRED EMBODIMENTS

Figure 1:
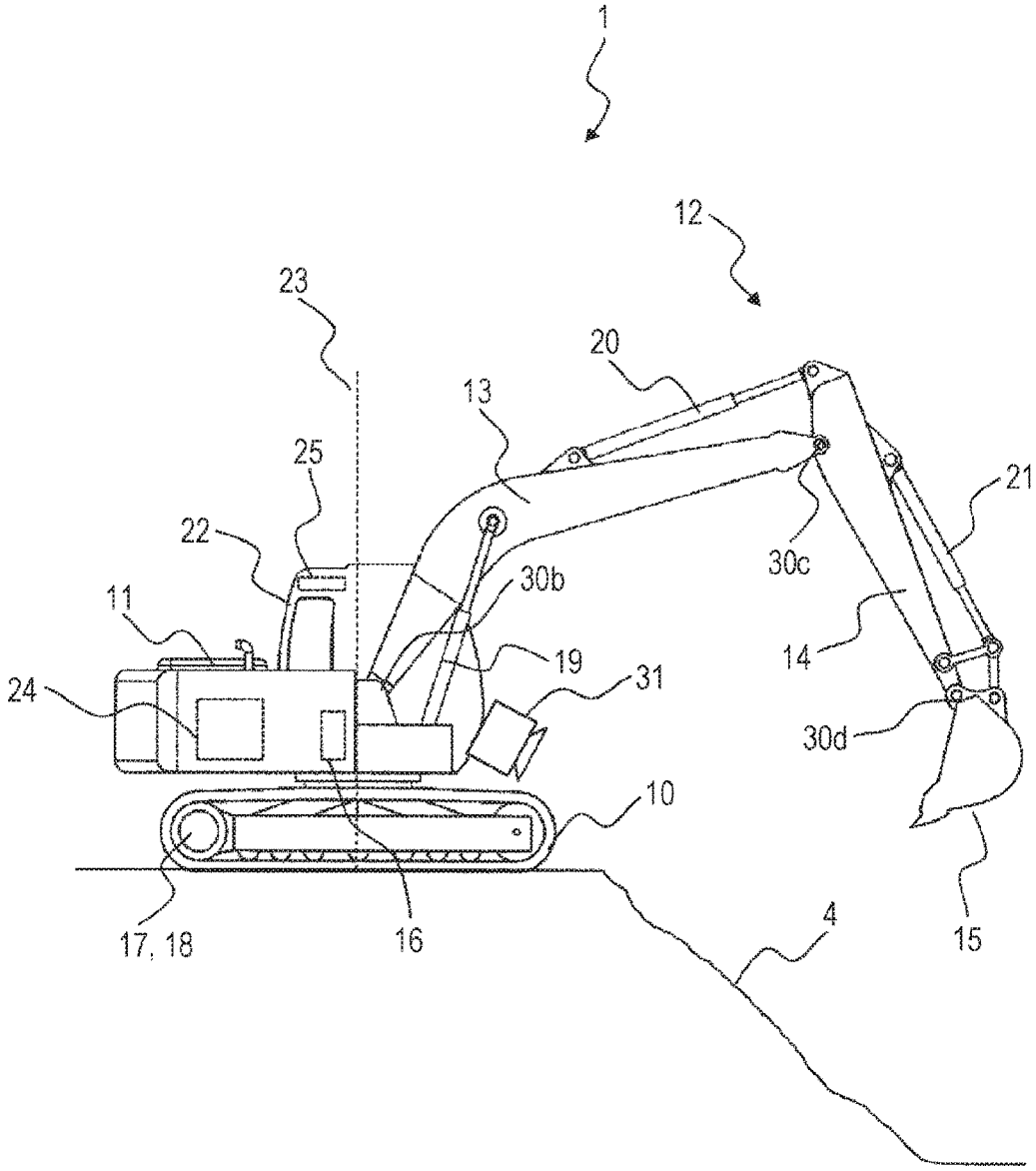
FIG. 1 is an exterior view of a hydraulic shovel according to an embodiment of the present invention.

Preferred embodiments of the present invention will be described in detail below with reference to the accompanying drawings, wherein like reference numerals refer to like parts throughout, and the repeated descriptions may be omitted. The present invention is not limited to the embodiments and various changes and modifications can be made by those skilled in the art, in a range of the technical spirit disclosed in the present specification.

Configurations of a working machine and a control device and a trace generation controller (trace generation device) attached to the working machine will be described using FIGS. 1 to 4.

FIG. 1 is an exterior view of a hydraulic shovel 1 to be an example of the working machine. The hydraulic shovel 1 includes a lower traveling body 10, a left traveling motor 17 and a right traveling motor 18 to drive the lower traveling body, an upper turning body 11 provided turnably in the lower traveling body 10, a turning motor 16 to turn the upper turning body 11, a boom 13 provided rotatably in the upper turning body 11, an arm 14 provided rotatably in a leading edge of the boom, a bucket 15 provided rotatably in a leading edge of the arm, cylinders 19 to 21 to rotate the boom 13, the arm 14, and the bucket 15, respectively, an operation room 22 in which an operator gets to operate the shovel, a control lever 26 (not illustrated in the drawings) provided in the operation room 22, and an operator interface 27 (not illustrated in the drawings). A front mechanism 12 includes the boom 13, the arm 14, the bucket 15, and the cylinders 19 to 21. A range-finding camera 31 to acquire a shape of an excavation surface 3 is provided in front of the operation room 22. The boom 13, the arm 14, and the bucket 15 include angle sensors 30*b* to 30*d* to detect respective rotation angles. The cylinders 19 to 21 include pressure sensors 36*a* to 36*f* (not illustrated in the drawings) to detect respective pressures. The hydraulic shovel 1 further includes a trace generation controller (trace generation device) 25 that generates an operation of the front mechanism 12, on the basis of information output from the control lever 26, the angle sensors 30*b* to 30*d*, and the pressure sensors 36*a* to 36*f*.

Figure 2:
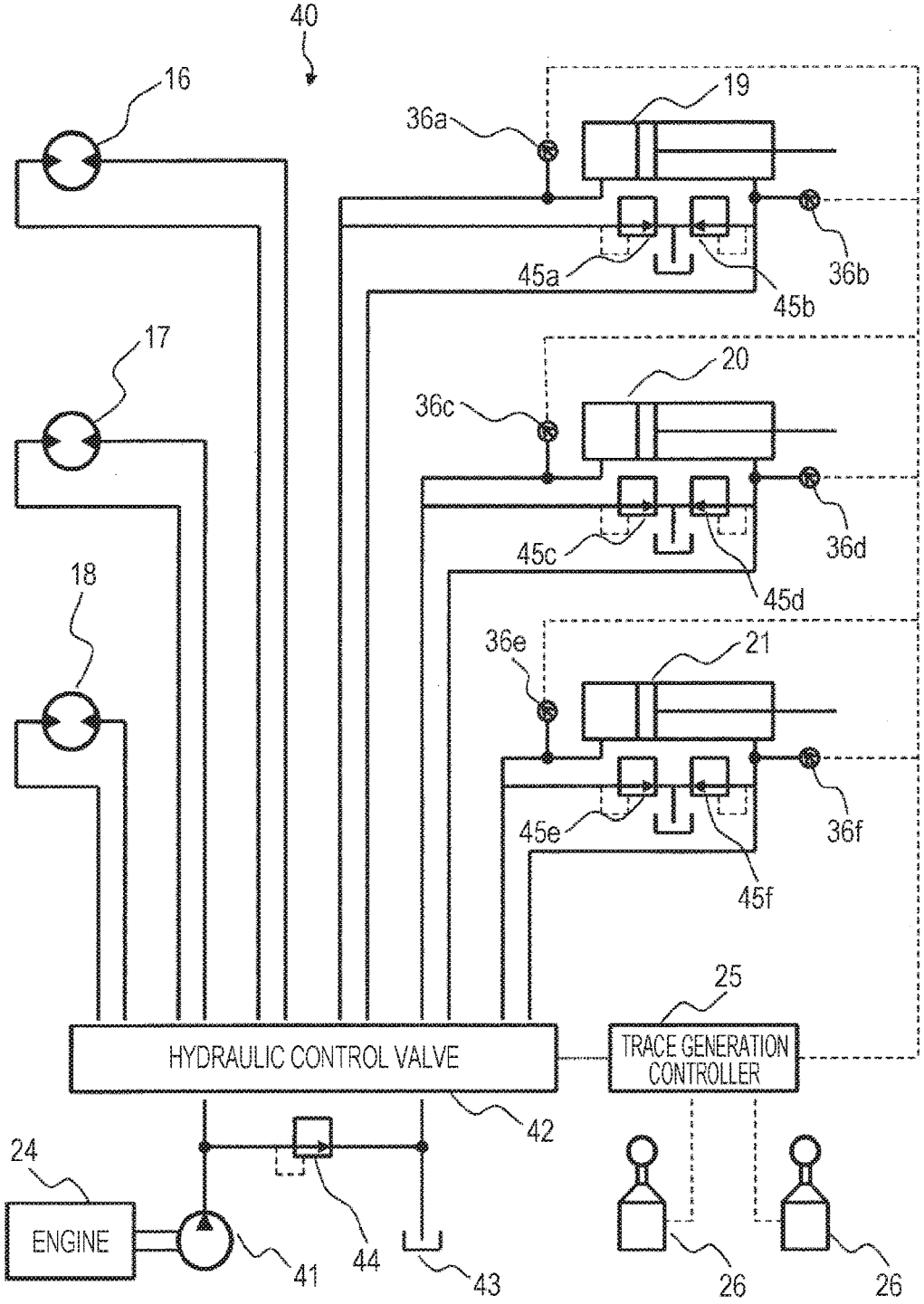
FIG. 2 is a circuit diagram of a hydraulic drive device to drive the hydraulic shovel according to the embodiment of the present invention.

FIG. 2 is a circuit diagram of a hydraulic drive device that is mounted on the hydraulic shovel 1 illustrating the example of this embodiment and drives the turning motor 16, the traveling motors 17 and 18, and the cylinders 19 to 21. A hydraulic drive device 40 includes a hydraulic pump 41 that is driven by an engine 24, a hydraulic control valve 42 that controls a flow of hydraulic oil supplied from the hydraulic pump 41 to the turning motor 16, the traveling motors 17 and 18, and the cylinders 19 to 21, and a tank 43 that stores return oil.

The hydraulic control valve 42 is configured to be connected to the trace generation controller 25 and adjust an amount of pressure oil supplied to each actuator by an electric signal output from the trace generation controller 25.

A relief valve 44 is connected to an oil passage of the pressure oil ejected from the hydraulic pump 41 and a maximum pressure of the oil passage can be adjusted. In addition, relief valves 45*a* to 45*f* are connected to the oil passage of the pressure oil to connect the hydraulic control valve 42 and the cylinders 19 to 21, a maximum pressure of each oil passage can be adjusted, and maximum generation forces of the cylinders 19 to 21 are determined by setting of the relief valves 45*a* to 45*f*.

Pressure sensors 36*a* to 36*f* are attached to the oil passage of the pressure oil to connect the hydraulic control valve 42 and the cylinders 19 to 21 and pressures of the cylinders 19 to 21 can be measured.

Figure 3:
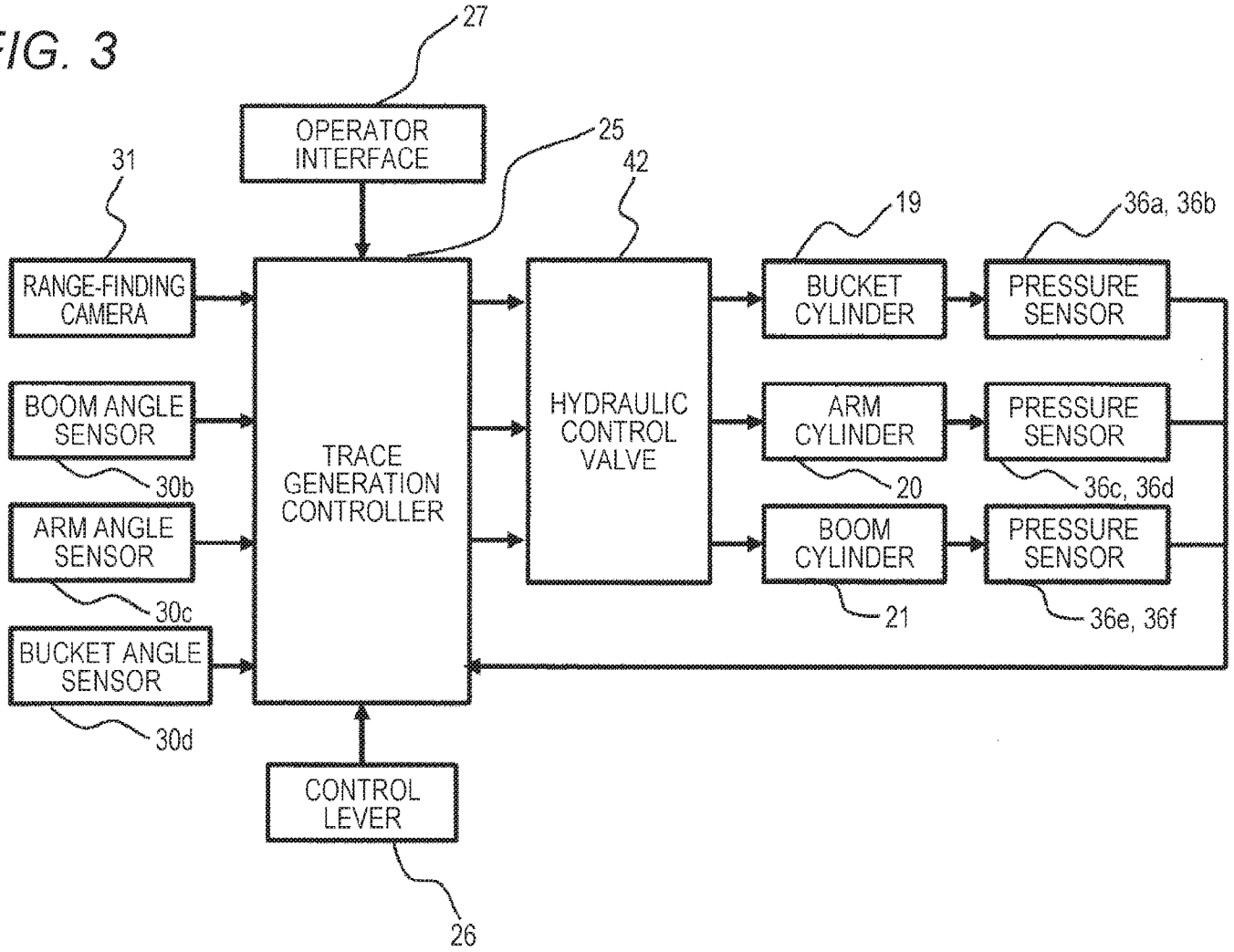
FIG. 3 is a block diagram of a control device to drive the hydraulic shovel according to the embodiment of the present invention.

FIG. 3 is a block diagram of a control device to drive the hydraulic shovel 1 illustrating the example of this embodiment. The trace generation controller 25 is configured to generate a candidate trace and a generated trace of an excavation work, on the basis of range-finding data of the range-finding camera 31 and a setting value given by the operator interface 27. In addition, the trace generation controller 25 is configured to acquire angle information of the front mechanism from the angle sensors 30*b* to 30*d*, drive the hydraulic control valve 42 to follow the generated trace, and output a command to drive the cylinders 19 to 21. In addition, the trace generation controller 25 is configured to acquire information regarding the pressures of the cylinders 19 to 21 from the pressure sensors 36*a* to 36*f* and operate a current position of the bucket 15 and a load acting on the bucket 15.

The control lever 26 is connected to the trace generation controller 25 and the front mechanism 12 can be driven directly by an operator.

Figure 4:
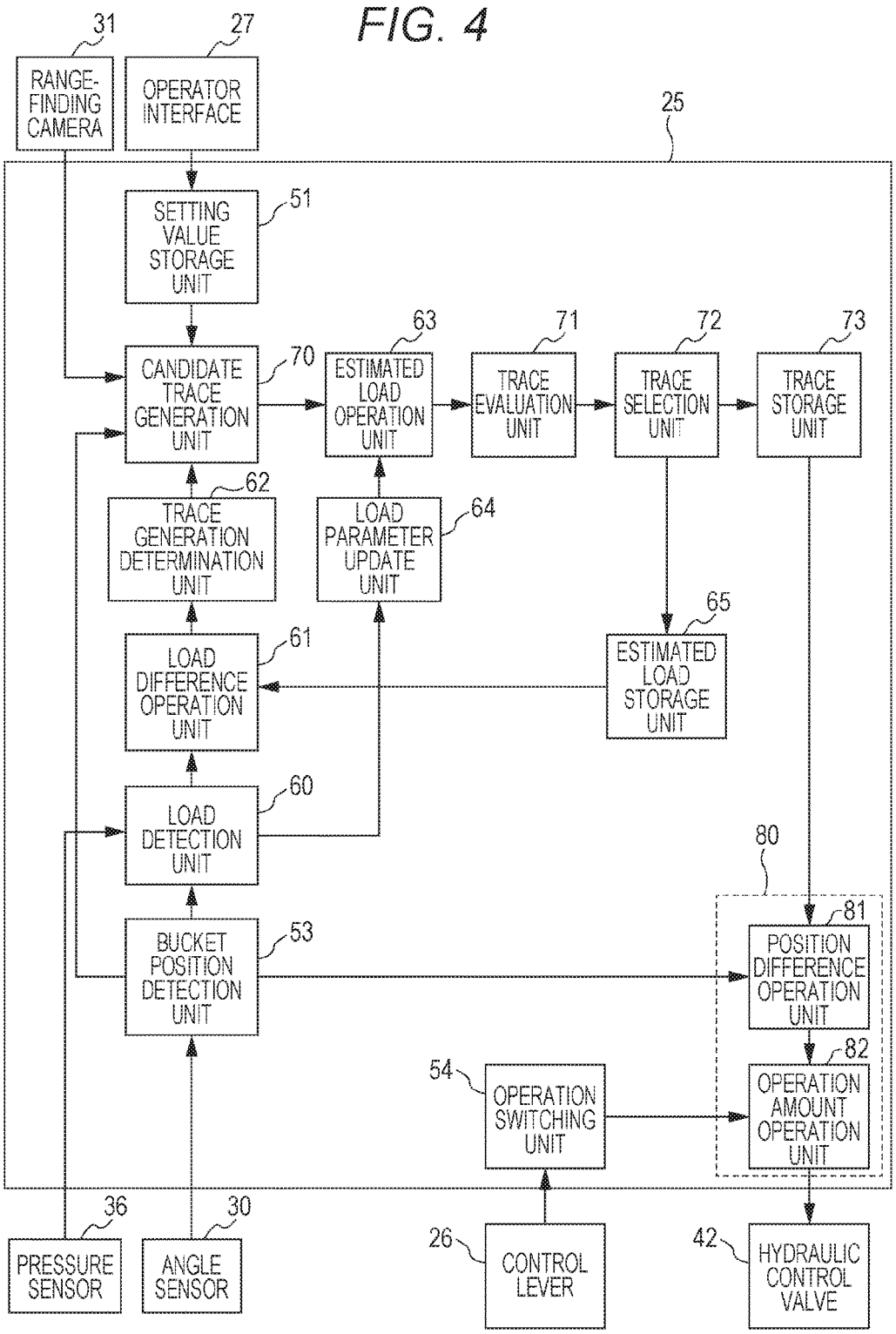
FIG. 4 is a block diagram illustrating the detail of a function of a trace generation controller to drive the hydraulic shovel according to the embodiment of the present invention.

FIG. 4 is a block diagram illustrating the detail of a function of the trace generation controller 25 illustrating the example of this embodiment. The trace generation controller 25 includes a setting value storage unit 51 that stores setting values regarding trace generation input by the operator by the operator interface 27, a bucket position detection unit 53 that detects a current position of the bucket 15, on the basis of the angle information of the front mechanism 12 output from the angle sensors 30*b* to 30*d*, and a load detection unit 60 that detects a load acting on the bucket 15, on the basis of the pressure information of the cylinders 19 to 21 output from the pressure sensors 36*a* to 36*f* and the bucket position output from the bucket position detection unit 53. In FIG. 4, the angle sensors 30*b* to 30*d* are collectively represented as an angle sensor 30 and the pressure sensors 36*a* to 36*f* are collectively represented as a pressure sensor 36. In this embodiment, the current position of the bucket 15 is described as a current position of a leading edge of the bucket 15.

The trace generation controller 25 further includes a candidate trace generation unit 70 that generates a plurality of candidate traces in which a current position of the bucket 15 during work is used as a start point and a work amount is almost constant, on the basis of the setting value output from the setting value storage unit 51, the range-finding data output from the range-finding camera 31, and trace generation (replan) determination of the bucket position detection unit 53 and a trace generation determination unit 62 to be described below, an load estimation unit 63 that operates estimated loads of the plurality of candidate traces, on the basis of load parameters output from a load parameter update unit 64 to be described below and the plurality of candidate traces output from the candidate trace generation unit 70, a trace evaluation unit 71 that operates evaluation amounts of the plurality of candidate traces, on the basis of the estimated loads of the plurality of candidate traces output from the load estimation unit 63, a trace selection unit 72 that selects a generated trace having an optimal evaluation amount from the plurality of candidate traces, on the basis of the evaluation amounts of the plurality of candidates traces output from the trace evaluation unit 71, and a trace storage unit 73 that stores the generated trace selected by the trace selection unit 72.

The trace generation controller 25 further includes an operation switching unit 54 that determines whether an operation is executed automatically or is executed manually, on the basis of the control command of the operator output from the control lever 26 and the setting value of the operator interface 27, and adjusts an output of a lever operation amount and a trace following control unit 80 that operates a drive operation amount of the bucket 15, on the basis of the generated trace output from the trace storage unit 73, the current position of the bucket output from the bucket position detection unit 53, and the lever operation amount output from the operation switching unit 54. The trace following control unit 80 includes a position difference operation unit 81 that operates a position difference to be a difference of the generated trace output from the trace storage unit 73 and the current position of the bucket output from the bucket position detection unit 53 and an operation amount operation unit 82 that operates control amounts of the cylinders 19 to 21, on the basis of the position difference output from the position difference operation unit 81 and the lever operation amount output from the operation switching unit 54, and outputs an operation amount of the hydraulic control valve 42 to drive the cylinders 19 to 21. That is, the trace following control unit 80 outputs the operation amount of the hydraulic control valve 42 to drive the cylinders 19 to 21 and controls the bucket 15 according to the generated trace selected by the trace selection unit 72.

The trace generation controller 25 further includes a load parameter update unit 64 that updates load parameters used for an operation of the estimated load, on the basis of an actual load acting on the bucket 15, output from the load detection unit 60, an estimated load storage unit 65 that stores the estimated load in the generated trace operated by the load estimation unit 63 and selected by the trace selection unit 72, a load difference operation unit 61 that operates a load difference to be a difference of the actual load output from the load detection unit 60 and the estimated load output from the estimated load storage unit 65, and a trace generation determination unit 62 that determines whether generation of the candidate trace is necessary in the middle of excavation, on the basis of the load difference of the load acting on the bucket 15, output from the load difference operation unit 61, and a predetermined value, and outputs a command to the candidate trace generation unit 70 to generate the candidate trace. That is, after the command of the trace generation determination unit 62 is output, the candidate trace generation unit 70 generates the candidate trace in which the work amount is almost constant. The trace generation determination unit 62 may determine whether the generation of the candidate trace is necessary on the basis of the load difference and may perform the determination on the basis of the actual load and the predetermined value. The load parameter update unit 64 may update the load parameters after the trace generation determination unit 62 determines that the trace generation is performed.

Figure 5:
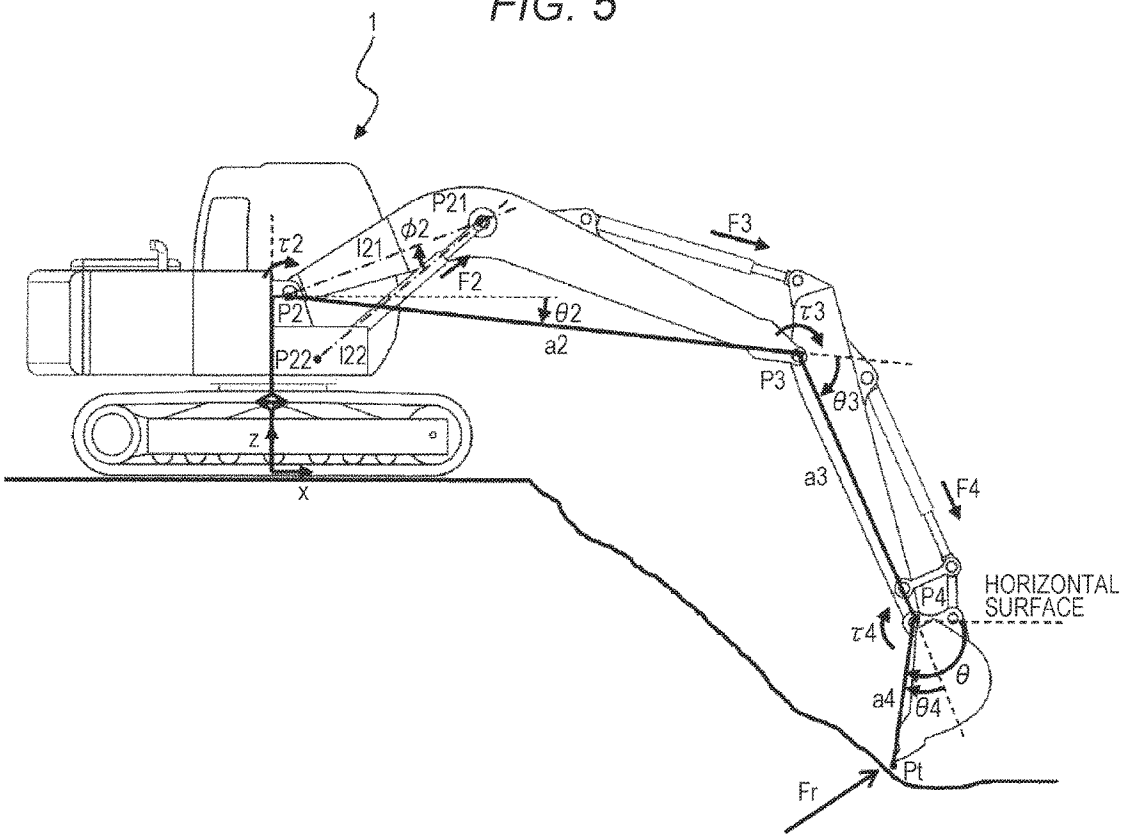
FIG. 5 is a lateral view illustrating parameters of the hydraulic shovel.

FIG. 5 is a lateral view illustrating parameters regarding a length and an angle of the hydraulic shovel 1. The boom 13 is represented as a segment a2 between a rotation fulcrum P2 of the boom 13 and a rotation fulcrum P3 of the arm 14. Likewise, the arm 14 is represented as a segment a3 between the rotation fulcrum P3 of the arm 14 and a rotation fulcrum P4 of the bucket 15 and the bucket 15 is represented as a segment a4 between the rotation fulcrum P4 of the bucket 15 and a leading edge position Pt of the bucket 15.

A boom angle θ2 is represented as an angle formed by the rotation fulcrum P2 of the boom 13 and a horizontal surface. Likewise, an arm angle θ3 is represented as an angle formed by an extension of a2 and a3, a bucket angle θ4 is represented as an angle formed by an extension of a3 and a4, and a bucket posture angle θ is represented as an angle formed by a4 and the horizontal surface.

If boom cylinder thrust is represented as F2, a segment between the rotation fulcrum P2 of the boom 13 and a fulcrum P21 of the boom cylinder 19 in the boom 13 is represented as 121, a segment between the fulcrum P21 and a fulcrum P22 of the boom cylinder 19 in the upper turning body 11 is represented as 122, and an angle formed by 121 and 122 is represented as ϕ2, boom torque τ2 acting on the rotation fulcrum P2 of the boom 13 is represented as $\tau 2 = F2 \times 121 \times \sin(\phi 2)$. Likewise, arm torque τ3 and bucket torque τ4 are represented as functions of arm cylinder thrust F3 and arm cylinder thrust F4, respectively. Each of the cylinder thrusts F2, F3, and F4 is represented as a product of a cylinder pressure and a pressure reception area of the cylinder.

The coordinates of the leading edge position Pt of the bucket 15 can be represented from a geometric relation of the front mechanism.

The excavation load Fr acting on the leading edge of the bucket 15 can be represented using a result obtained by inversely converting the torques τ2 to τ4 and the geometric relation of the front mechanism.

Figure 6:
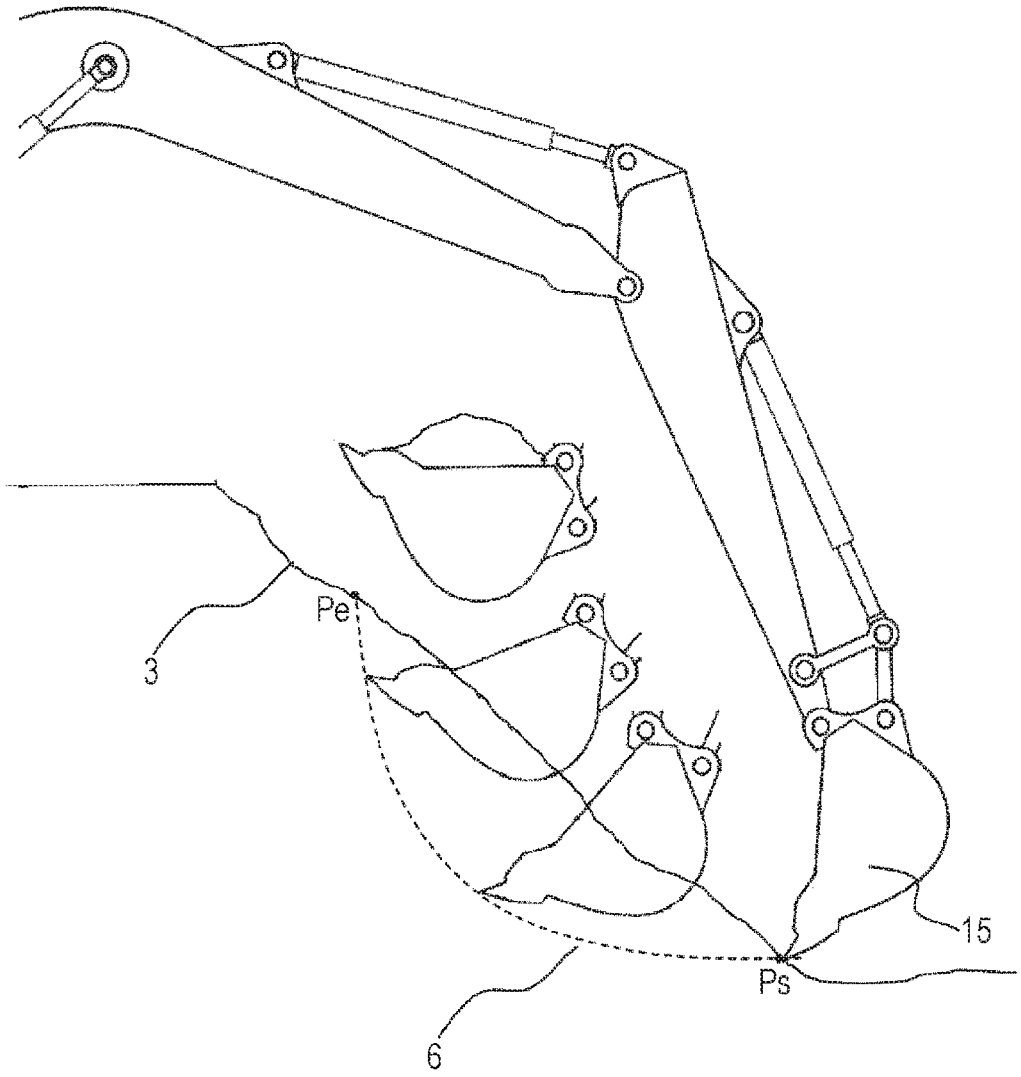
FIG. 6 is a lateral view illustrating an example of an excavation work by the hydraulic shovel and a lateral view illustrating a plurality of work tool positions during excavation.

FIG. 6 is a lateral view illustrating an example of the excavation work by the hydraulic shovel and a lateral view illustrating a plurality of work tool positions during the excavation. Generally, the hydraulic shovel 1 continuously drives the bucket 15 according to an excavation trace 6 of a circular arc shape, from an excavation start point Ps to an excavation end point Pe of the excavation surface 3, and performs the excavation work.

Generally, the hydraulic shovel 1 alternately repeats the excavation work and the loading work, until a transporting machine such as a dump truck is filled fully. At this time, it is preferable to decrease the number of times of performing the loading work in the excavation work to improve efficiency of the work for filling the transporting machine fully and perform excavation of an appropriate amount as fast as possible without excess and deficiency to prevent an excavation time from increasing due to an excessive excavation amount.

Next, methods of updating the work and modifying the work by the hydraulic shovel 1 to be the example of the embodiment of the present invention will be described using FIGS. 7 to 10.

Figure 7:
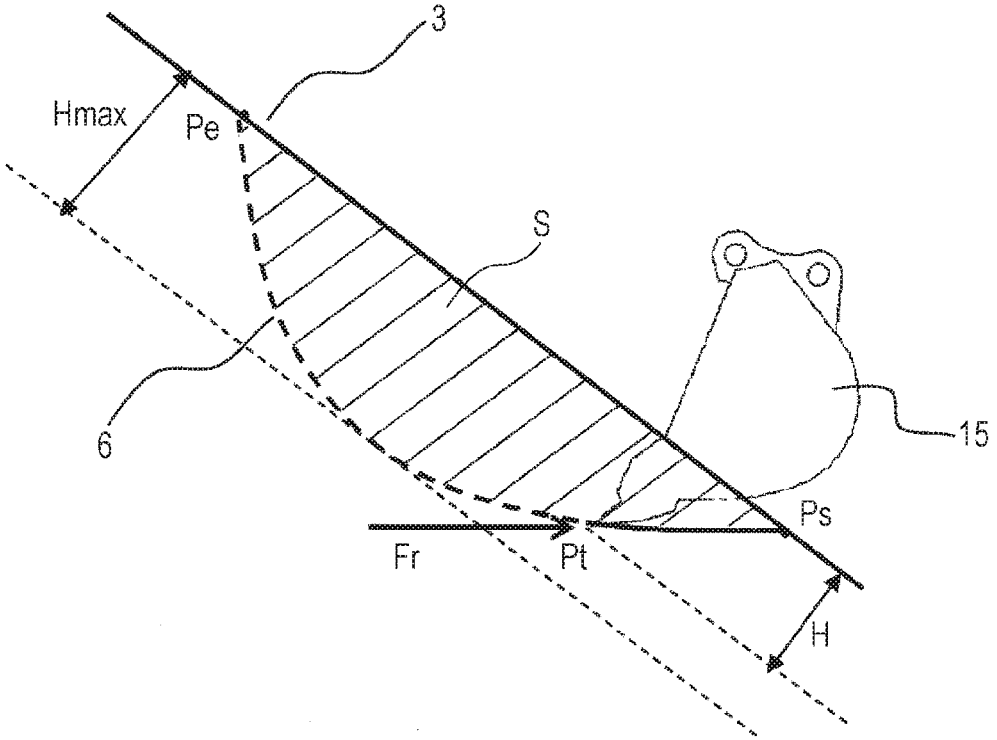
FIG. 7 is a cross-sectional view illustrating parameters regarding a trace of the work tool.

FIG. 7 is a cross-sectional view illustrating parameters regarding the excavation trace 6 of the bucket 15. An excavation amount in the hydraulic shovel 1 can be represented as a function of a passage area S surrounded by a surface shape from the excavation start point Ps to the excavation end point Pe on the excavation surface 3 and an excavation trace 6. In this embodiment, an excavation amount can be calculated by a product of the passage area S and the width W of the bucket 15.

The excavation trace 6 can be represented by a function using the excavation amount, the excavation start point Ps, the excavation end point Pe, and a plurality of setting values set by the operator interface 27 as parameters. In this embodiment, the excavation trace 6 is represented as a curve coupling three points of the excavation start point Ps, the excavation end point Pe, and a point of a shape obtained by shifting a shape of the excavation surface 3 output from the range-finding camera 31 by a maximum excavation depth Hmax in parallel to the shape. As the curve, a circular arc of a perfect circle, a circular arc of an elliptical circle, and a Bezier curve using three points are considered. At this time, if the excavation start point Ps is fixed and the passage area S is constantly maintained, the excavation end point Pe corresponding to the maximum excavation depth Hmax can be obtained uniquely.

The excavation load Fr actually acting on the leading edge of the bucket 15 in the excavation load Fr acting on the leading edge of the bucket 15 is defined as an actual load Fr2 and the excavation load Fr represented as an excavation load function using the excavation depth H is defined as an estimated load Fr1. An expression of the excavation load function is a function acquired by causing measured data to regress and is represented as $Fr1 = C1 \times f(H) + C2$ using load parameters C1 and C2 of an excavation target, in this embodiment. f(H) is a candidate trace and is a trace obtained by applying the excavation depth H on the basis of the position of the excavation start point Ps, the passage area S, and the temporary maximum excavation depth Hmax.

Figure 8:
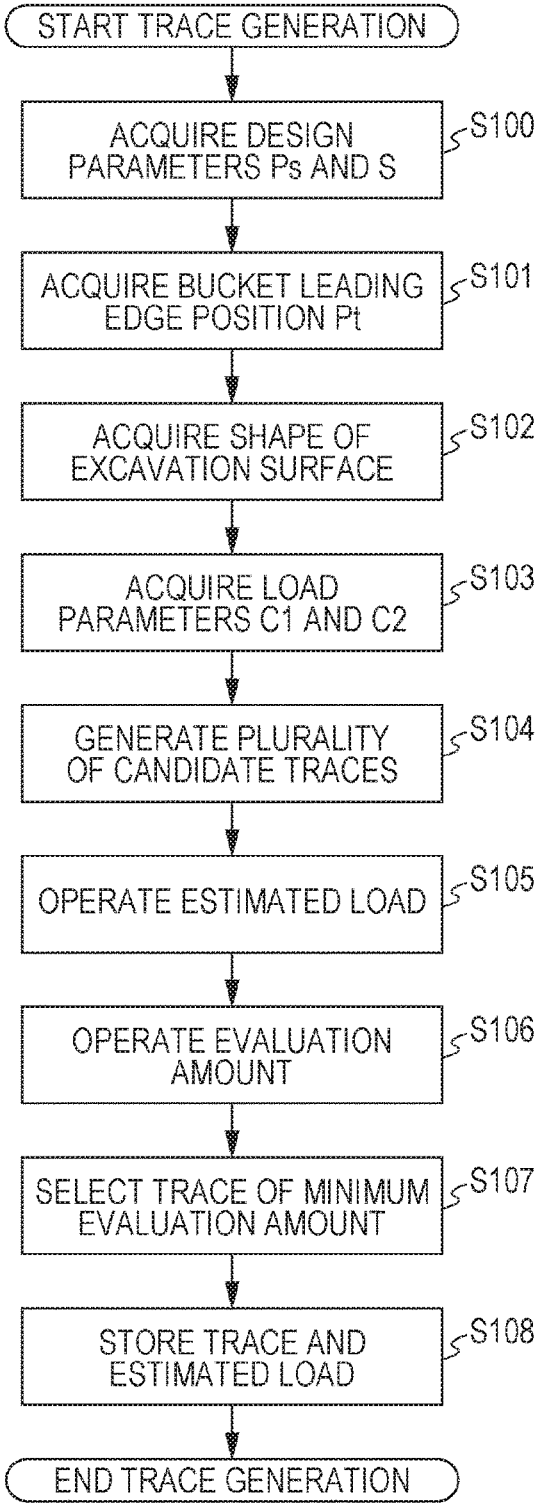
FIG. 8 is a flowchart illustrating a trace generation method of the work tool.

FIG. 8 is a flowchart illustrating a trace generation method of a work tool in the trace generation controller 25.

<S100>

If trace generation starts, the position of the excavation start point Ps and the passage area S to be the parameters used in the trace generation, output from the setting value storage unit 51, are acquired.

<S101>

Next, the coordinates of the leading edge position Pt of the bucket 15 output from the bucket position detection unit 53 are acquired.

<S102>

Next, the shape of the excavation surface 3 output from the range-finding camera 31 is acquired.

<S103>

Next, the load parameters C1 and C2 output by the load parameter update unit 64 are acquired. Initial values of the load parameters C1 and C2 are set previously using a setter.

<S104>

Next, the plurality of candidate traces are generated by applying the excavation depth H on the basis of the position of the excavation start point Ps, the passage area S, and the temporary maximum excavation depth Hmax to be the acquired setting parameters.

<S105>

The estimated loads Fr1 of the plurality of candidate traces are operated on the basis of the load parameters C1 and C2.

<S106>

Next, work amounts of the bucket 15 to be integrations of the estimated loads Fr1 of the plurality of candidate traces are operated and the work amounts are output as evaluation amounts of the candidate traces.

<S107>

Next, a trace having a minimum evaluation amount among the plurality of evaluation amounts acquired by S106 is selected. The trace having the minimum evaluation amount is set as a generated trace.

<S108>

Next, the trace having the minimum evaluation amount is stored in the trace storage unit 73. At the same time, the estimated load Fr1 in the trace having the minimum evaluation amount in S105 is stored in the estimated load storage unit 65.

FIG. 8 illustrates a flow in which the plurality of candidate traces are calculated at one time and the trace having the minimum evaluation amount is selected from the plurality of candidate traces. However, a method of generating one candidate trace, instead of the plurality of candidate traces, calculating an evaluation amount, and generating a candidate trace until a trace having a minimum evaluation amount is calculated is also considered. For example, a method of executing an operation of an evaluation amount of one generated candidate trace by S106 and returning the process to S104, generating a new candidate trace, and calculating an evaluation amount, when the evaluation amount is not minimum, is considered. The trace having the minimum evaluation amount is selected, so that an appropriate trace in which a load is reduced can be selected.

Figure 9:
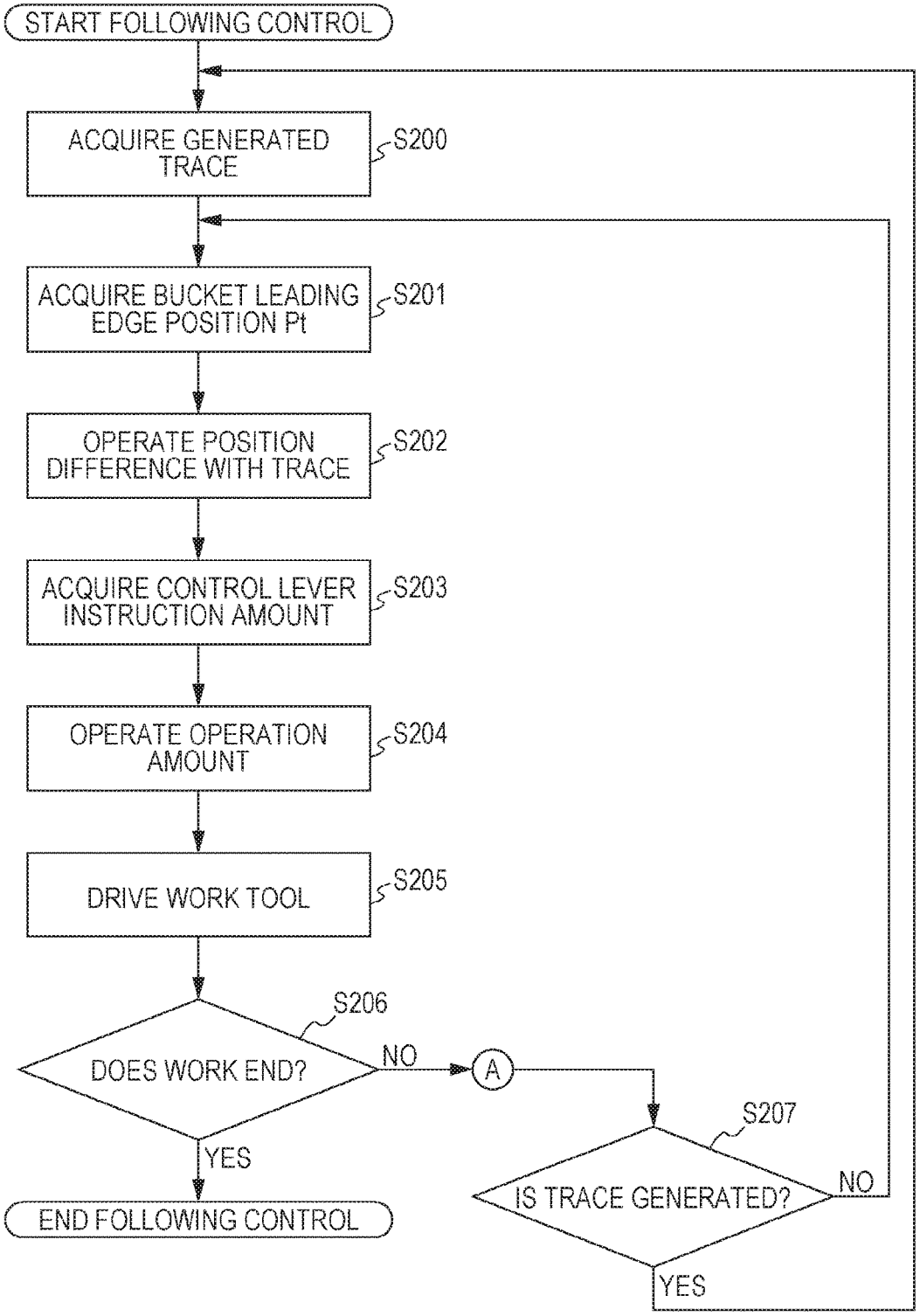
FIG. 9 is a flowchart illustrating a trace following control method of the work tool.

FIG. 9 is a flowchart illustrating a trace following control method of the work tool in the trace following control unit 80.

<S200>

If the trace following control starts, the generated trace stored in the trace storage unit 73 is acquired.

<S201>

Next, the leading edge position Pt of the bucket 15 is acquired to execute the trace following control.

<S202>

Next, a position difference of the leading edge position Pt of the bucket 15 output from the bucket position detection unit 53 and the generated trace is operated.

<S203>

Next, a command of a reception method of control by the operator set by the setting value storage unit 51 and an operation instruction amount output from the operation switching unit 54 are acquired.

<S204>

Next, an operation amount for the hydraulic control valve 42 is operated on the basis of the position difference of the trace, the command of the reception method of the control by the operator, and the operation instruction amount. As a result, feedback control can be executed such that the bucket 15 is driven according to the acquired generated trace.

<S205>

Next, the operation amount is output to the hydraulic control valve 42 and the work tool is driven by the hydraulic drive device 40.

<S206>

Next, it is determined whether the excavation work ends. When it is determined that the work ends, the trace following control ends. When it is determined that the work does not end, the process proceeds to a load detection section A.

<S207>

If the process returns from the load detection section A, it is determined whether the command of the trace generation is output in the load detection section A. When it is determined that the trace generation is not commanded, the process returns to S201 and following of the generated trace is executed. When it is determined that the trace generation is commanded, the process returns to S200, a new generated trace is acquired, and following of the trace is executed.

Timing when the load detection section A ends may be timing before S202 of FIG. 9 and may be timing immediately after S205, depending on a calculation amount of the load detection section A.

Figure 10:
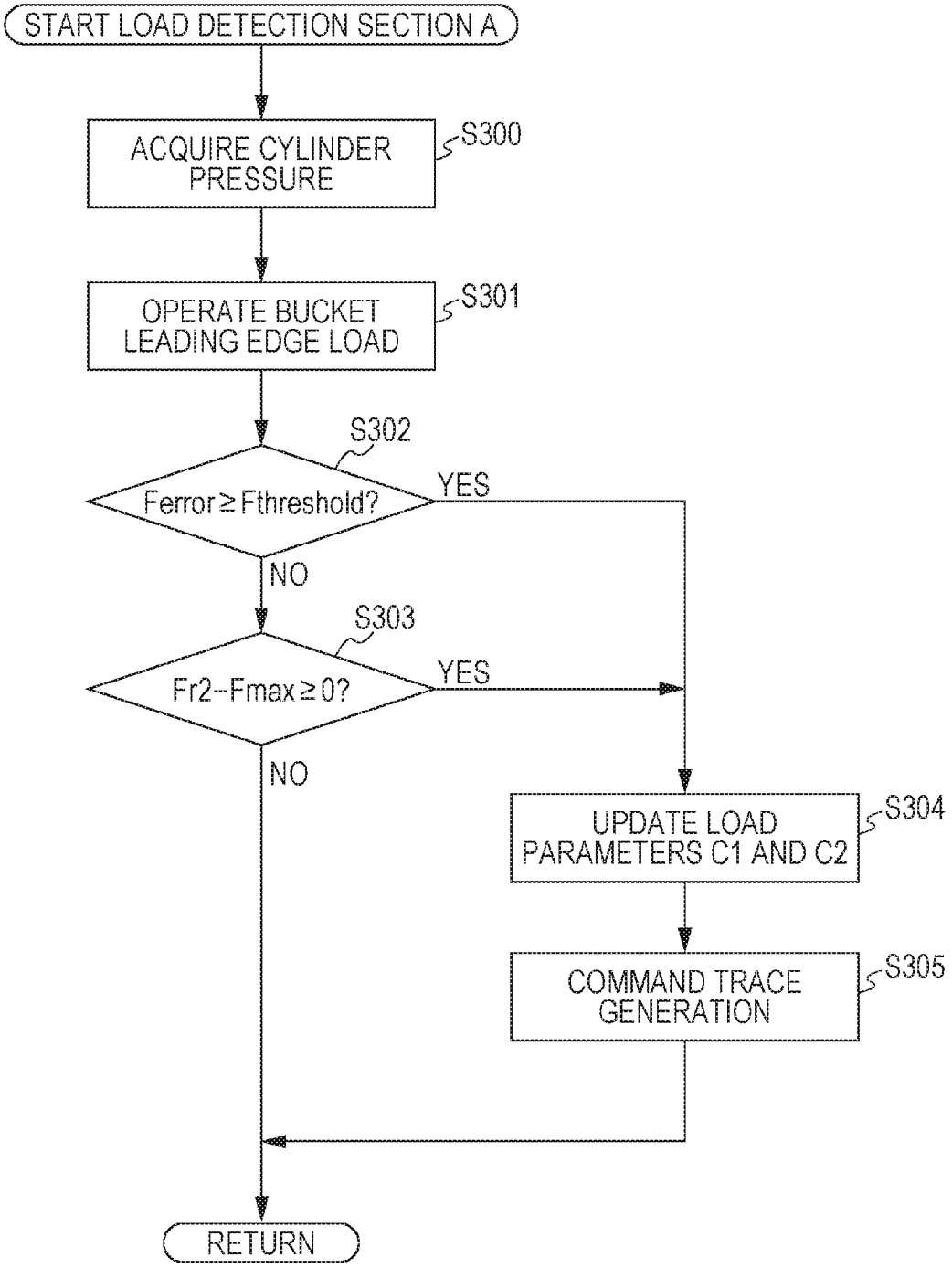
FIG. 10 is a flowchart illustrating a method of determining whether generation of the trace of the work tool is necessary and a method of updating load parameters.

FIG. 10 is a flowchart of the load detection section A and a flowchart illustrating a method of determining whether generation of the trace is necessary in the trace generation controller 25 and a method of updating load parameters.

<S300>

First, pressure information of the cylinders is acquired on the basis of an output of the pressure sensor 36.

<S301>

Next, the cylinder thrusts F2, F3, and F4 are operated on the basis of the pressure information of the cylinders and the actual load Fr2 acting on the leading edge of the bucket 15 is operated on the basis of the cylinder thrusts F2, F3, and F4 and the position of the bucket 15 output from the bucket position detection unit 53.

<S302>

Next, it is determined by the trace generation determination unit 62 whether a load difference Ferror to be a difference of the actual load Fr2 and the estimated load Fr1 to be the reference load, calculated by the load difference operation unit 61, is equal to or larger than a predetermined value Fthreshold. That is, the trace generation determination unit 62 outputs a command of the trace generation, when the difference of the actual load Fr2 and the estimated load Fr1 to be the reference load is equal to or larger than the predetermined value Fthreshold during the excavation. The predetermined value Fthreshold is set as 0.2 times to 0.4 times of a maximum value of the estimated load Fr1.

<S303>

When it is determined that Ferror is smaller than Fthreshold, it is determined by the trace generation determination unit 62 whether a difference of the actual load Fr2 and a predetermined allowed load Fmax to be the reference load is equal to or larger than a predetermined value. That is, the trace generation determination unit 62 outputs a command of the trace generation, when the difference of the actual load Fr2 and the allowed load Fmax to be the reference load is equal to or larger than the predetermined value during the excavation. In this embodiment, the predetermined value is set as 0. When Fr2 is smaller than Fmax, the process returns to the trace following control unit 80. As such, the trace generation determination unit 62 outputs the command of the trace generation, when the difference of the actual load Fr2 and the reference load is equal to or larger than the predetermined value during the excavation.

<S304>

When it is determined that the load difference Ferror is equal to or larger than the predetermined value Fthreshold and when it is determined that the actual load Fr2 is equal to or larger than the allowed load Fmax, the load parameters of the excavation target are updated. The load parameters C1 and C2 can be operated by a least square method, on the basis of the transition of the actual load Fr2 and the transition of the excavation depth H.

<S305>

Next, a command of generation of a new candidate trace is output to the candidate trace generation unit 70 and the load detection section A ends.

FIG. 10 illustrates an example of the case in which S303 is executed after S302. The order of S302 and S303 may be changed. In the case of No in S302, the process does not proceed to S303 and the process may return to the trace following control unit 80. That is, the process may return by only one step of S302 and S303. In addition, the order of S304 and S305 may be changed.

A modification operation of the work will be described using FIGS. 11 to 13.

Figure 11:
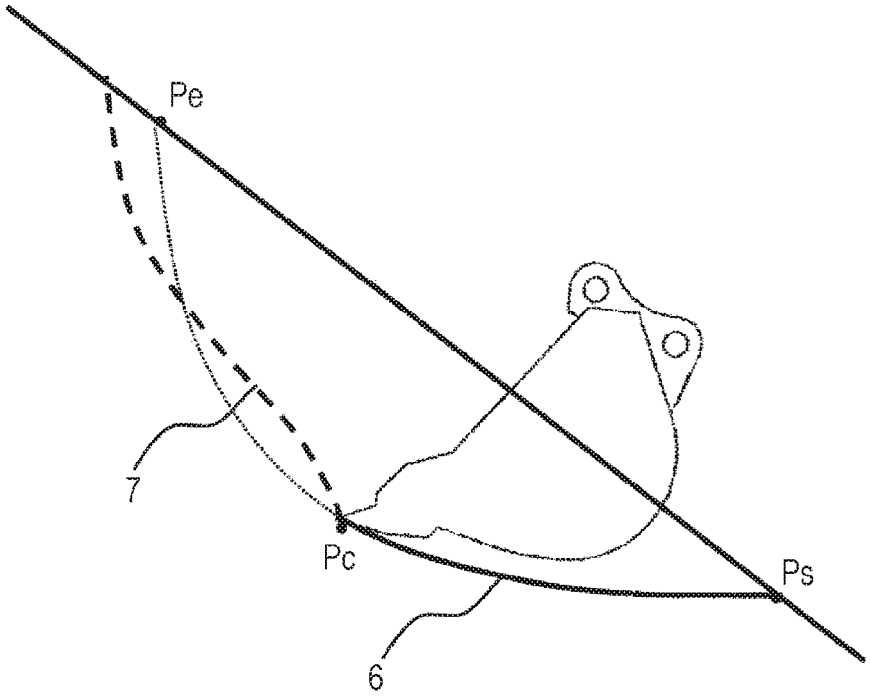
FIG. 11 is a cross-sectional view illustrating the generated trace of the work tool.

FIG. 11 is a cross-sectional view illustrating the generated trace of the work tool. If the hydraulic shovel 1 executes the excavation work and a trace is generated at a point Pc on the excavation trace 6, the trace changes to a new generated trace 7. The generated trace 7 is a trace selected from the plurality of candidate traces by the trace selection unit 72. At this time, passage areas S when the excavation is performed according to the excavation trace 6 and when the excavation is performed according to the generated trace 7 become the same. As a result, the excavation can be performed according to the new generated trace 7 in which the excavation amount is almost constant, preferably, the excavation amount is constant.

Figure 12:
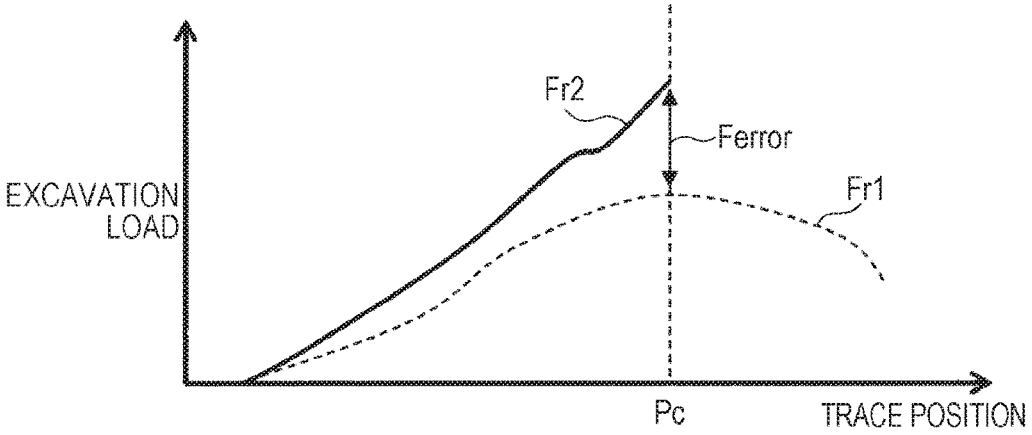
FIG. 12 is a graph illustrating the magnitude of a load for a trace position of the work tool and a graph illustrating a condition where a difference of an actual load and a predicted load becomes equal to or larger than a predetermined value and a modification of the trace is executed.

FIG. 12 is a graph illustrating a change of the excavation load Fr for the trace position. When the position of the bucket 15 moves, that is, the excavation progresses, the excavation depth H increases and the actual load Fr2 increases. When the load parameters C1 and C2 at the time of generating the trace are small, the estimated load Fr1 decreases. For this reason, the load difference Ferror increases. If the load difference Ferror becomes equal to or larger than the predetermined value Fthreshold on the point Pc on the trace, in the generated trace 7, the load applied to the leading edge of the bucket 15 is not estimated accurately. Therefore, when the load difference Ferror is equal to or larger than the predetermined value Fthreshold, the load parameters C1 and C2 are updated and the command of the trace generation is output in S304 and S305 (refer to FIG. 10), and a new trace is generated. As a result, the generated trace 7 in which the load applied to the leading edge of the bucket 15 is estimated accurately can be generated. The new generated trace 7 becomes the generated trace 7 in which the load is reduced and the work amount is almost constant, preferably, the work amount is constant. Therefore, working efficiency of the excavation can be raised.

Figure 13:
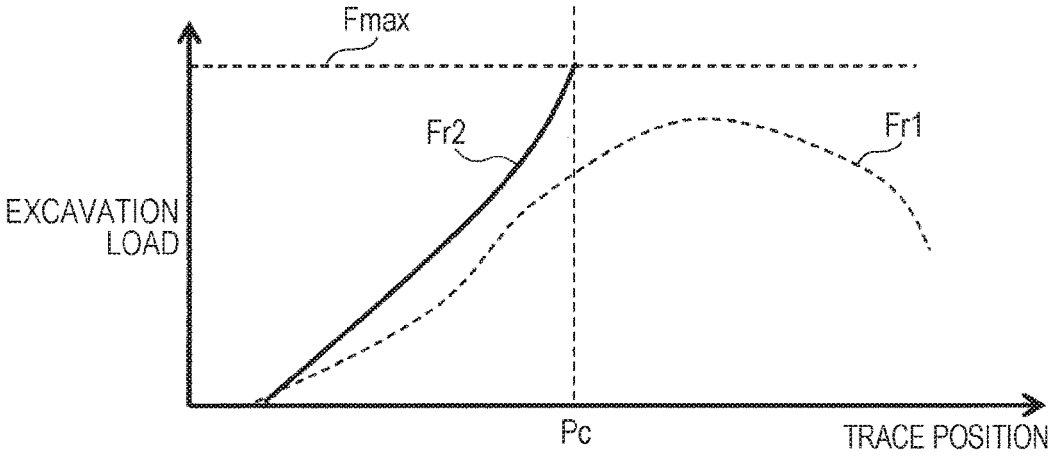
FIG. 13 is a graph illustrating the magnitude of a load for a trace position of the work tool and a graph illustrating a condition where an actual load becomes equal to or larger than a predetermined value and a modification of the trace is executed.

FIG. 13 is a graph illustrating a different change of the excavation load Fr for the trace position. When the position of the bucket 15 moves, that is, the excavation progresses, the excavation depth H increases and the actual load Fr2 increases. If the actual load Fr2 becomes equal to or larger than the allowed load Fmax to be the reference load on the point Pc on the trace, a large load is applied to the leading edge of the bucket 15 of the generated trace 7. For example, an excavation speed may become slow and working efficiency may be deteriorated. Therefore, when the difference of the actual load Fr2 and the allowed load Fmax to be the reference load is equal to or larger than the predetermined value, the load parameters C1 and C2 are updated and the command of the trace generation is output in S304 and S305 (refer to FIG. 10), and a new trace is generated. As a result, the excavation work can be continuously performed without deteriorating the working efficiency. The new generated trace becomes the generated trace 7 in which the load is reduced and the work amount is almost constant, preferably, the work amount is constant. Therefore, the excavation is performed without deteriorating the working efficiency of the excavation.

The present invention is not limited to the embodiment and various modifications are included. For example, the working machine 1 is not limited to the form illustrated in FIG. 1 and can be applied to a robot manipulator.

The detection of the shape of the work target is not limited to the range-finding camera 31 and other configuration capable of acquiring the shape of the work target may be used. For example, a laser range finder or an ultrasonic sensor may be used alternatively. In addition, a trace may be generated using an acquired result of geographic data from the outside.

When the actual load Fr2 is acquired, the pressure sensors 36*a* to 36*f* are not necessarily used and a different load detection method represented by a load cell or a strain gauge may be used.

A form of the function representing the work load is not limited to this embodiment. The work load may be represented as a function of the bucket posture angle θ or the distance from the excavation start point to the current position and may be represented as a function having a plurality of variables.

In the evaluation of the candidate trace in the trace evaluation unit 71, the evaluation amount is not limited to the excavation amount or the work amount. For example, an estimation result of a work time based on a mechanism simulation or an estimation result of a fuel consumption amount may be used and an evaluation amount obtained by combining them may be used.

The determination of the trace generation command in the trace generation determination unit 62 is not limited to the load difference or the comparison of the loads in this embodiment. For example, an integral value or a differential value of the load difference may be used. In addition, the determination of the trace generation command is not limited to the load acting on the work tool and the magnitude of the load acting for each actuator may be used for the determination.

The generation of the trace by the candidate trace generation unit 70 and the trace generation determination unit 62 is not necessarily executed by the determination by the magnitude of the load and generation may be repeated with a constant cycle and a trace may be continuously generated during the work.

The trace generation controller 25 is not necessarily included in the hydraulic shovel 1. For example, the trace generation controller 25 may be included outside the hydraulic shovel, like a system for executing centralized management on a plurality of hydraulic shovels. In addition, the trace generation controller 25 may be included over both the centralized management system and the hydraulic shovel.

What is claimed is:

1. A trace generation device comprising:

at least one processor for executing stored instructions to:

determine whether a difference of an actual load applied to a bucket and a reference load is equal to or larger than a predetermined value during excavation:

output a command of trace generation, when the difference is equal to or larger than the predetermined value; and based on the output of the command of trace generation:

determine a position of an excavation start point a passage area, and a temporary maximum excavation depth, determine a plurality of candidate traces by applying an excavation depth based on the position of the excavation start point the passage area, and the temporary maximum excavation depth, and select a trace from the plurality of candidate traces in which a work amount is almost constant.

2. The trace generation device according to claim 1, wherein the reference load is an estimated load, and the at least one processor outputs the command of the trace generation, when the difference of the actual load and the estimated load is equal to or larger than the predetermined value during the excavation.

3. The trace generation device according to claim 1, wherein the reference load is an allowed load, and the at least one processor outputs the command of the trace generation, when the difference of the actual load and the allowed load is equal to or larger than the predetermined value during the excavation.

4. The trace generation device according to claim 1, wherein the at least one processor:

operates estimated loads of the plurality of candidate traces using load parameters, wherein the selection of the trace from the plurality of candidate traces is on the basis of the estimated loads;

controls the bucket according to the selected trace; and updates the load parameters used for the operation of the estimated loads, using the actual load, wherein the at least one processor further:

generates the plurality of candidate traces in which a work amount is almost constant, using a current position of the bucket during work as the excavation start point, and determines whether generation of the trace is necessary during the excavation, on the basis of the actual load acting on the bucket.

5. A working machine comprising the trace generation device according to claim 1.

* * * * *